US009284834B2

(12) United States Patent
Alteirac et al.

(10) Patent No.: US 9,284,834 B2
(45) Date of Patent: Mar. 15, 2016

(54) DOWNHOLE DATA TRANSMISSION SYSTEM

(75) Inventors: Laurent Alteirac, Nesoya (NO); Christophe M Rayssiguier, Melun (FR); Carlos Merino, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 663 days.

(21) Appl. No.: 13/517,980

(22) PCT Filed: Dec. 27, 2010

(86) PCT No.: PCT/US2010/062124

§ 371 (c)(1), (2), (4) Date: Jul. 23, 2012

(87) PCT Pub. No.: WO2011/082122

PCT Pub. Date: Jul. 7, 2011

(65) Prior Publication Data

US 2012/0286967 A1 Nov. 15, 2012

Related U.S. Application Data

(60) Provisional application No. 61/290,256, filed on Dec. 28, 2009.

(51) Int. Cl.

| | |
|---|---|
| ***G01V 3/00*** | (2006.01) |
| ***E21B 47/12*** | (2012.01) |
| ***E21B 47/14*** | (2006.01) |

(52) U.S. Cl.

CPC ..... *E21B 47/12* (2013.01); *E21B 47/122* (2013.01); *E21B 47/14* (2013.01)

(58) Field of Classification Search

None

See application file for complete search history.

(56) References Cited

U.S. PATENT DOCUMENTS

| | | | | |
|---|---|---|---|---|
| 4,609,873 | A * | 9/1986 | Cox et al. | 324/338 |
| 4,779,236 | A | 10/1988 | Sondergeld | |
| 5,510,582 | A * | 4/1996 | Birchak et al. | 181/102 |
| 5,691,712 | A * | 11/1997 | Meek et al. | 340/853.3 |
| 6,816,082 | B1 * | 11/2004 | Laborde | 340/853.3 |
| 6,909,666 | B2 * | 6/2005 | Dubinsky et al. | 367/81 |
| 7,234,519 | B2 * | 6/2007 | Fripp et al. | 166/250.01 |
| 8,125,848 | B2 * | 2/2012 | Geerits et al. | 367/50 |
| 2002/0195247 | A1 | 12/2002 | Ciglenec et al. | |
| 2003/0058739 | A1 * | 3/2003 | Hsu et al. | 367/56 |
| 2003/0142586 | A1 * | 7/2003 | Shah et al. | 367/82 |
| 2005/0157699 | A1 * | 7/2005 | Sakai | 370/351 |
| 2005/0232178 | A1 * | 10/2005 | Cubley et al. | 370/315 |
| 2006/0013065 | A1 * | 1/2006 | Varsamis et al. | 367/76 |
| 2006/0113803 | A1 | 6/2006 | Hall et al. | |
| 2006/0214814 | A1 | 9/2006 | Pringnitz et al. | |
| 2006/0260801 | A1 | 11/2006 | Hall et al. | |
| 2008/0225930 | A1 * | 9/2008 | Proctor et al. | 375/214 |
| 2008/0253228 | A1 * | 10/2008 | Camwell et al. | 367/82 |
| 2009/0272536 | A1 * | 11/2009 | Burns et al. | 166/302 |
| 2011/0050452 | A1 * | 3/2011 | Kusuma et al. | 340/853.7 |
| 2013/0027216 | A1 * | 1/2013 | Jantz et al. | 340/854.4 |

* cited by examiner

*Primary Examiner* — Curtis King

(74) *Attorney, Agent, or Firm* — Cameron R. Sneddon; Diana M. Sangalli

(57) ABSTRACT

A method and system are disclosed herein relating to transmitting data within a borehole. The method and system include having a transmitter disposed at a first location within the borehole and configured to generate a first signal, and more than one receiver and/or repeater disposed at a second location within the borehole. The receivers and/or repeaters are configured to receive the first signal, and further are configured to communicate with each other.

22 Claims, 6 Drawing Sheets

DOWNHOLE DATA TRANSMISSION SYSTEM

CROSS-REFERENCE TO RELATED APPLICATION

This application claims the priority benefit of U.S. Provisional Patent Application No. 61/290,256, filed by Applicant on 28 Dec. 2009, the entire contents of which is hereby incorporated by reference herein.

FIELD OF DISCLOSURE

Embodiments disclosed herein relate generally to a communication system for use with installations in oil and gas wells or the like. More specifically, but not by way of limitation, embodiments disclosed herein relate to a downhole data transmission system for transmitting and receiving data and control signals between a location down a borehole and the surface, or between downhole locations themselves.

BACKGROUND

One of the more difficult problems associated with any borehole is to communicate measured data between one or more locations down a borehole and the surface, or between downhole locations themselves. For example, in the oil and gas industry it is desirable to communicate data generated downhole to the surface during operations such as drilling, perforating, fracturing, and drill stem or well testing; and during production operations such as reservoir evaluation testing, pressure and temperature monitoring. Communication is also desired to transmit intelligence from the surface to downhole tools or instruments to effect, control or modify operations or parameters.

Accurate and reliable downhole communication is particularly important when complex data comprising a set of measurements or instructions is to be communicated, i.e., when more than a single measurement or a simple trigger signal has to be communicated. For the transmission of complex data it is often desirable to communicate encoded analog or digital signals.

In oilfield exploration and production operations, it is a common industry practice to perform downhole testing that provides information relevant to the borehole (e.g., downhole temperature, pressure, fluid flow, viscosity, etc.). This testing may be performed by deploying tools and/or a bottom hole assembly downhole, in which information and data from the tools and assembly may be recovered later after the tools have been retrieved back at the surface. However, with this testing method, if the information and data recorded by the tools and bottom hole assembly are corrupted and/or insufficient, such as by having a failure within the testing equipment, this insufficiency within the data may not be apparent until after the tools have been retrieved back at the surface. Further, while the downhole tools are being operated, an oil-rig operator may not have access to the information being recorded downhole until the retrieval of the downhole tools at the surface. As such, the operator may not be able to compensate and adjust the downhole conditions within the borehole until after the tools and/or assembly has been retrieved.

Other testing methods have also been developed to provide two-way communication between the borehole tools and/or bottom hole assembly and the surface. One method involves placing a cable into the borehole that runs from the surface near the drilling rig down to the data recording tools. However, such a use of a cable may obstruct the flow of fluids within tubulars downhole. Further, the cable would have to be safely and properly managed, as the cable could easily be damaged while either inside or outside of the tubulars. Furthermore, the cable may also obstruct the disconnection of the downhole tubulars from the surface in the case of an emergency disconnection between the two.

Other methods have then been developed to provide wireless two-way communication between the borehole and the surface, such as by using acoustic and/or electromagnetic signals to enable communication. For example, referring to FIG. 1A, a schematic view is shown of a downhole communication system 101. The communication system 101 includes a section having one or more downhole tools 103, such as an MWD tool recording and transmitting data. The recorded data from the downhole tools 103 may then be sent to other tools adjacent thereto, or the data may be sent to the surface for evaluation.

As mentioned, when using the downhole tools 103 to transmit data, the data may be transmitted wirelessly using acoustic and/or electromagnetic signals. The electromagnetic or acoustic wireless signals may be used for shorter ranged applications, such as transferring data within and between downhole tools 103 that are adjacent to each other, commonly referred to as the "short hop section." Alternatively, or in addition thereto, the electromagnetic or acoustic signals may be used for longer ranged applications, such as transferring data between the downhole tools 103 and the surface, commonly referred to as the "long hop section."

When the distance between the downhole tools 103 and the surface is too far to transmit the wireless signal via the short hop section, then the long hop section may be used to receive the data signals from the short hop section and re-transmit the signals at a higher level and/or higher power. These signals re-transmitted by the long hop section may then be received by the surface, thereby having the signals from the downhole tools 103 transmitted to the surface.

To re-transmit the signals from the short hop section, the long hop section may include one or more devices, commonly referred to as repeaters, disposed downhole that receive and re-transmit the wireless signals. For example, as shown in FIG. 1A, five repeaters 105 have been added to the communication system 101 to transmit and carry the data from the downhole tools 103 to the surface.

Furthermore, in another method, a wireless two-way communication system may include more than one short hop section, such as by having multiple tools disposed downhole in different sections within a borehole. In such a system, each of the different short hop sections may transmit information and data signals therefrom to adjacent short hop sections and/or adjacent long hop sections. For example, referring to FIG. 1B in another schematic view, multiple downhole tools 103 are disposed downhole at different sections such that the data from each of these tools 103 may be transmitted to the surface. As such, multiple repeaters 105, particularly six repeaters 105 in this embodiment, may be used to provide communication between the short hop sections and the long hop sections, thereby transmitting the data from each of the downhole tools 103 to the surface.

However, in such wireless communication systems, the failure of one or more of the components within the long hop section (e.g., repeaters within a long hop section) may result in a complete loss of communication within the system. For example, the system may no longer be able to re-transmit signals within the long hop section of the communication system. This may necessitate the redeployment of additional communication components downhole, thereby resulting in additional costs (particularly within a rig environment) and increasing the time until production from the well is received.

SUMMARY OF DISCLOSURE

In one aspect, one or more embodiments of the present invention relate to a system for transmitting data within a borehole. The system includes a first transmitter disposed at a first location within the borehole and configured to generate a first signal, and a first receiver and a second receiver disposed at a second location within the borehole. Each of the first receiver and the second receiver are configured to receive the first signal, and the first receiver and the second receiver are configured to communicate with each other.

In another aspect, one or more embodiments of the present invention relate to a system for transmitting data within a borehole. The system includes a first transmitter disposed at a first location within the borehole and configured to generate a first signal, and a first repeater and a second repeater disposed at a second location within the borehole. Each of the first repeater and the second repeater are configured to receive the signal and re-transmit the first signal, and the first repeater and the second repeater are configured to communicate with each other.

In yet another aspect, one or more embodiments of the present invention relate to a method for transmitting data within a borehole. The method includes disposing a transmitter at a first location within the borehole, and disposing a first receiver and a second receiver at a second location within the borehole, in which the first receiver and the second receiver are configured to communicate with each other. The method the further includes transmitting a signal with the transmitter to one of the first receiver and the second receiver.

Other aspects and advantages of the invention will be apparent from the following description and the appended claims.

BRIEF DESCRIPTION OF DRAWINGS

Implementations of the present invention may be better understood when consideration is given to the following detailed description thereof. Such description makes reference to the annexed pictorial illustrations, schematics, graphs, drawings, and appendices. In the drawings.

DETAILED DESCRIPTION

Figure 1A:
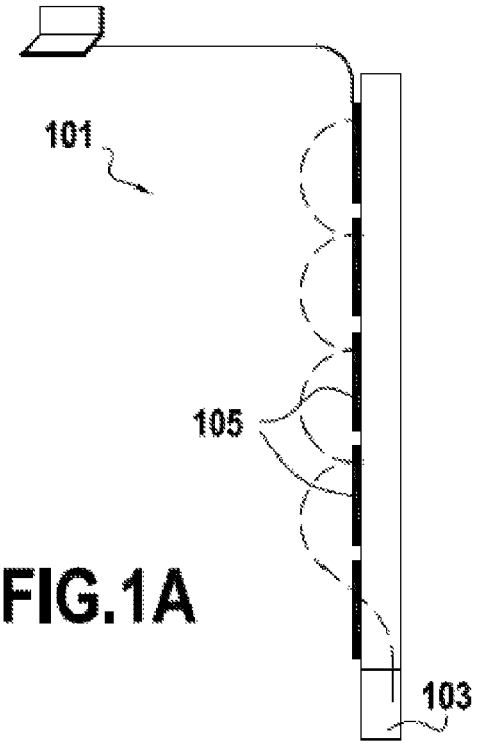
FIGS. 1A and 1B depict schematic views of a downhole communication system.
Figure 1B:
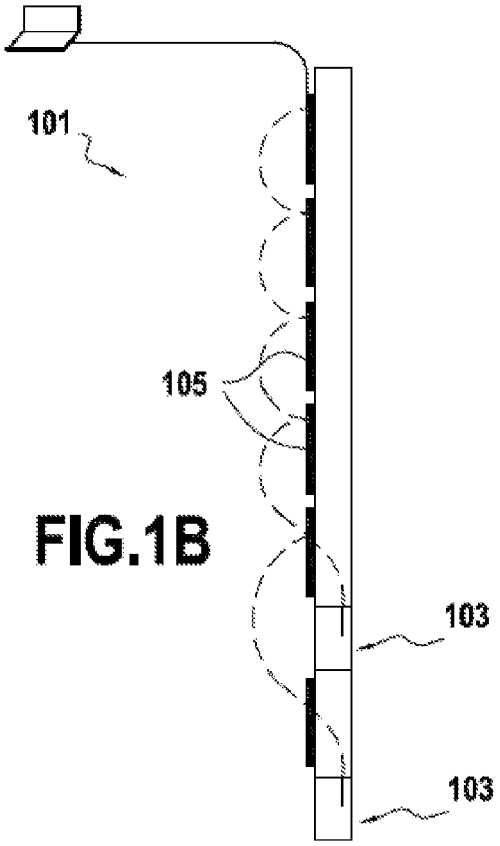

Specific embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

In one aspect, embodiments disclosed herein generally relate to a system to be used within a borehole and enable transfer and communication of data within a borehole to a drilling rig surface. The system includes having a transmitter disposed at a first location within a borehole, and having more than one receiver, such as two receivers, disposed at a second location within the borehole. The receivers may then be configured to communicate with each other, and may further be configured to receive a signal generated by the transmitter.

Moreover, one or more transmitters may also be disposed at the second location within the borehole. One or more of the receivers disposed at the second location may be combined with one or more of the transmitters, such as to form a repeater, in which the repeater is capable of receiving the first signal from the transmitter disposed at the first location. The repeaters may then be able to further re-transmit the signal received from the transmitter, such as by continuing to transmit the signal either uphole to the surface, or downhole to enable communication with a downhole tool. Furthermore, by having the receivers, or repeaters as they may be, at the second location in communication with each other, these receivers may be capable of alternating usage, in which one receiver, or certain electronic components/functions of one receiver, may be powered off while the other receiver is powered on. As such, the receivers may be wired and/or wirelessly connected to each other to enable the communication therebetween.

Figure 2A:
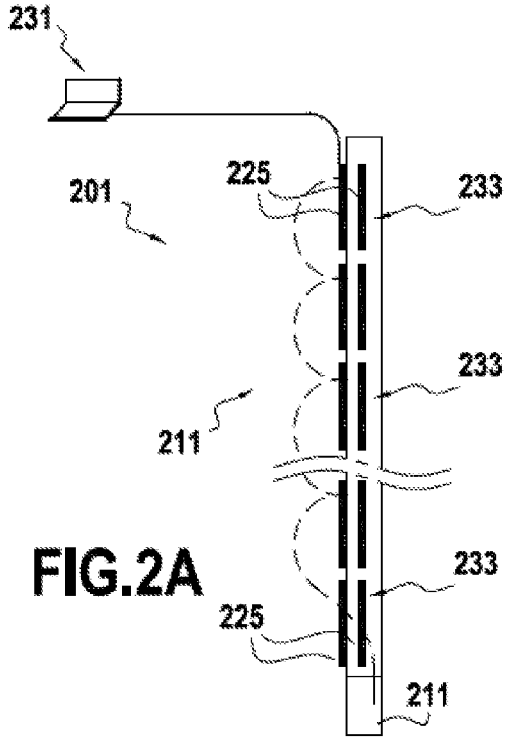
FIGS. 2A and 2B depict multiple schematic views of a communication system in accordance with embodiments disclosed herein.

Referring now to FIG. 2A, a schematic view of a communication system 201 in accordance with one or more embodiments is shown. The communication system 201 has a short hop section 211, which may include a bottom hole assembly and/or one or more downhole tools that communicate with each other, and has a long hop section 221, which may include multiple receivers, transmitters, additional downhole tools, and/or repeaters (a combination of a receiver and a transmitter, which may also be referred to as a 'transceiver'). The use of the long hop section 221 enables communication between the short hop section 211 and a surface 231 (e.g., a rig floor). As such, data that is recovered by the downhole tools within the short hop section 211 may be transferred from the short hop section 211 to the surface 231 using the long hop section 221, or alternatively may be transferred to the surface 231 via a series of short sections 211 or long hop sections 221. Examples of downhole tools used and disposed within a short hop section 211 may include a perforation gun, one or more packers, one or more valves, one or more sensors, one or more gauges, one or more samplers, one or more downhole flowmeters, and any other downhole tool that may be known in the art.

The short hop section 211 may include the use of a transmitter, in which the transmitter may be able to transmit a signal related to the data retrieved and recovered from the downhole tools included within the short hop section 211. The transmitter within the short hop section 211 may be able to generate and transmit a wireless signal, such as an acoustic signal and/or an electromagnetic signal. For example, to communicate and transfer a signal to the long hop section 221, the transmitter within the short hop section 211 may generate an acoustic signal, in which the acoustic signal will be received by the long hop section 221 and be transferred uphole to the surface 231.

Further, if more than one downhole tool and/or bottom hole assembly is included within short hop section 211, the transmitter within the short hop section 211 may generate a wireless signal to communicate within the tools of the short hop section 211. For example, the transmitter within the short hop section 211 may generate an electromagnetic signal that is received by one or more downhole tools and/or bottom hole assembly included within the short hop section 211. Furthermore, the short hop section 211 may also include the use of a receiver, in which the receiver may be able to receive a signal, such as a signal from the surface 231 via the long hop section 221, or from another location downhole.

As shown, the long hop section 221 may include one or more nodes 223, in which each of the nodes 223 includes one or more receivers, transmitters, and/or repeaters. For example, as shown in FIG. 2A, each of the nodes 223 includes more than one repeater 225, in which each repeater 225 includes a receiver and a transmitter formed therein. The receiver of one or more of the repeaters 225 may then be able to receive signals, such as receive a signal from another repeater 225 from another node 223, a signal from a repeater 225 from the same node 223, a signal from a transmitter from a short hop section 211, and/or a signal from a transmitter from the surface 231. The transmitter of one or more repeaters 225 may then be able to transmit signals, such as transmit a signal to another repeater 225 of another node 223, transmit a signal to a repeater 225 of the same node 223, transmit a signal to a receiver within a short hop section 211, and/or transmit a signal to a receiver at the surface 231. As such, signals from the long hop section 221 may be transmitted and received between the short hop section 211 and the surface 231, in addition to transmitting and receiving signals within the long hop section 221 itself.

Figure 2B:
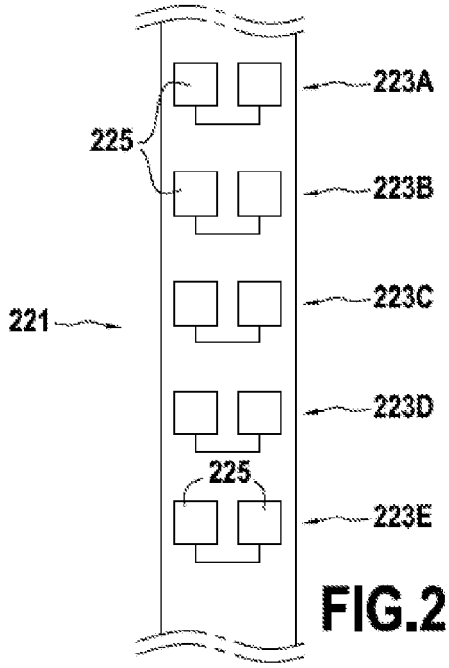

FIG. 2B then shows a schematic view of the long hop section 221, such as the long hop section 221 shown in FIG. 2A, in which each of the nodes 223 includes more than one repeater 225. Particularly, each of the nodes 223, in the embodiments shown in FIGS. 2A and 2B, includes two repeaters 225 disposed therein, but may practically include more than two repeaters 225 at each of the nodes 223.

By including at least two repeaters 225 within at least one, or each, of the nodes 223, the reliability of the system 201 may be increased. For example, in a system 201 where only one repeater 225 is included within each of the nodes 223 and each node 223 communicates with the repeater, transmitter, or receiver most closely above or below that node 223, if any one of the repeaters 225 within the system 201 fails, such as by having a power loss or a communication failure at one of the repeaters 225, the entire system 201 has a higher likelihood of failure in terms of communication between the surface 231 and a location downhole. However, by including more than one repeater at one or more of the nodes, such as shown within FIGS. 2A and 2B, the overall reliability of the system may be increased (discussed more below).

Further, in addition to having two repeaters within at least one, or each, of the nodes, the communication system may be able to include more repeaters at each node, if necessary or desired. For example, referring now to FIG. 3, a schematic view of a long hop section 321 in accordance with one or more embodiments is shown. Particularly, in a system having the long hop section 321, each node 323 may include three repeaters 325 disposed therein. As such, with this arrangement, the reliability of the system may be even further increased, such as with respect to the system 201 of FIGS. 2A and 2B.

The reliability of the system may be calculated using a set of one or more equations. For example, using the equations, as follows, the reliability of a system may be calculated, in which $R_{sys}$ represents the reliability of a system, $R_{node}$ represents the reliability at each node, $R_{unit}$ represents the reliability of each communication systems unit (such as a receiver, transmitter, and/or a repeater), $N_{nodes}$ represents the number of nodes, and $N_{units}$ represents the number of communication units at each node:

$$R_{sys}=R_{node}^{N_{nodes}} \quad \text{Equation (1)}$$

$$R_{node}=1-(1-R_{unit})^{N_{units}} \quad \text{Equation (2)}$$

As such, for a typical prior art communication system, in which the system includes ten nodes in a long hop section to enable communication from a short hop section to the surface, represented by $N_{nodes}$ equal to ten, the long hop section having only one repeater at each node, represented by $N_{units}$ equal to one, and a reliability of each communication unit, such as the reliability of a repeater, equal to about 90 percent, represented by $R_{unit}$ equal to 0.90, the reliability at each node $R_{node}$ and the reliability of the system $R_{sys}$ may be calculated. In such a communications system, the reliability at each node $R_{node}$ would be 0.90, or 90 percent, but the reliability of the entire system $R_{sys}$ would drop to about 0.35, or about 35 percent. As such, having a system reliability $R_{sys}$ of only about 35 percent may not be an acceptable industry standard, in which oil rig operators could expect a system failure almost two-thirds of the time.

However, for a system having more than one repeater at each node, such as the system shown in FIGS. 2A and 2B in which each node includes two repeaters, the system may still include ten nodes within the long hop section to enable communication from a short hop section to the surface, represented by $N_{nodes}$ equal to ten, and the system may still have a reliability of each communication unit equal to about 90 percent, represented by $R_{unit}$ equal to 0.90, but now may have two repeaters at each node, represented by $N_{units}$ equal to two, in which the reliability at each node $R_{node}$ and the reliability of the system $R_{sys}$ may be significantly increased.

Particularly, in such a system, the reliability at each node $R_{node}$ would increase to 0.99, or 99 percent, and the reliability of the entire system $R_{sys}$ would increase to about 0.904, or about 90.4 percent. As such, having a system reliability $R_{sys}$ of about 90.4 percent may be an acceptable industry standard, in which oil rig operators could expect the communication system to work properly more than nine times out of ten, thereby increasing the oil rig operators reliance on such a system.

Figure 3:
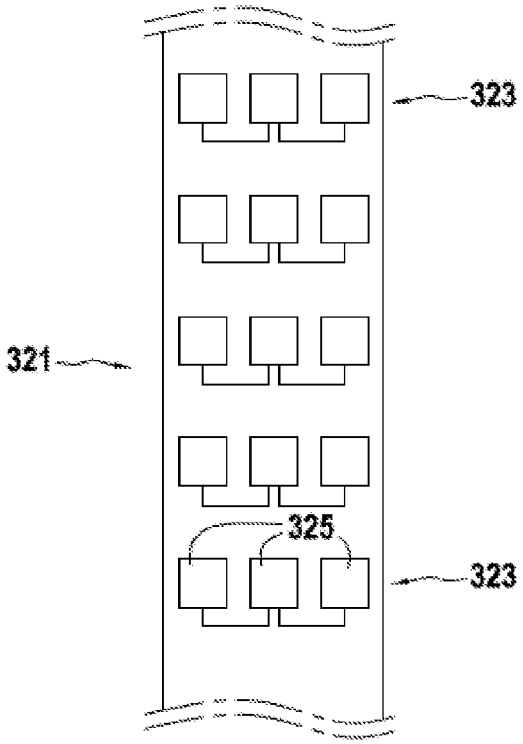
FIG. 3 depicts a schematic view of a communication system in accordance with embodiments disclosed herein.

Furthermore, for a system having three repeaters at each node, such as the system shown in FIG. 3, the reliability of the system $R_{sys}$ may still further increase. In such an embodiment having three repeaters at each node, the reliability at each node $R_{node}$ would increase to 0.999, or 99.9 percent, and the reliability of the entire system $R_{sys}$ would increase to about 0.99, or about 99 percent. A 99 percent reliability for an entire system $R_{sys}$ is a significant increase, particularly as compared to the reliability of the system $R_{sys}$ of 35 percent in which each node only includes one repeater. As such, depending on the costs and number of communication tools and resources available, an appropriate number of repeaters may be chosen for each node when determining a desired reliability for a system $R_{sys}$.

Further, in one or more embodiments, when arranging and developing a communication system for use within a borehole, preferably the spacing of each node within the long hop section of the communication system has "vertical redundancy", that is, each node is able to communicate with a node not only adjacent, such as the nodes most closely above or below each node, but also each node is able to communicate with a node having a spacing at least two nodes above or below each node.

For example, in such an embodiment, with reference to FIG. 2B, the nodes 223A-E of the long hop section 221 would enable communication therethrough, in which the node 223C is not only able to communicate with the node 223B most closely spaced thereabove and the node 223D most closely spaced therebelow, but the node 223C is also able to communicate with the node 223A having a spacing of two nodes thereabove, and is able to communicate with the node 223E having a spacing of two nodes therebelow. Such an arrangement within a communication system would even further increase the reliability of the system, in which the complete failure of communication at any one node would still enable the long hop section to enable communication from a short hop section to the surface.

Figure 4:
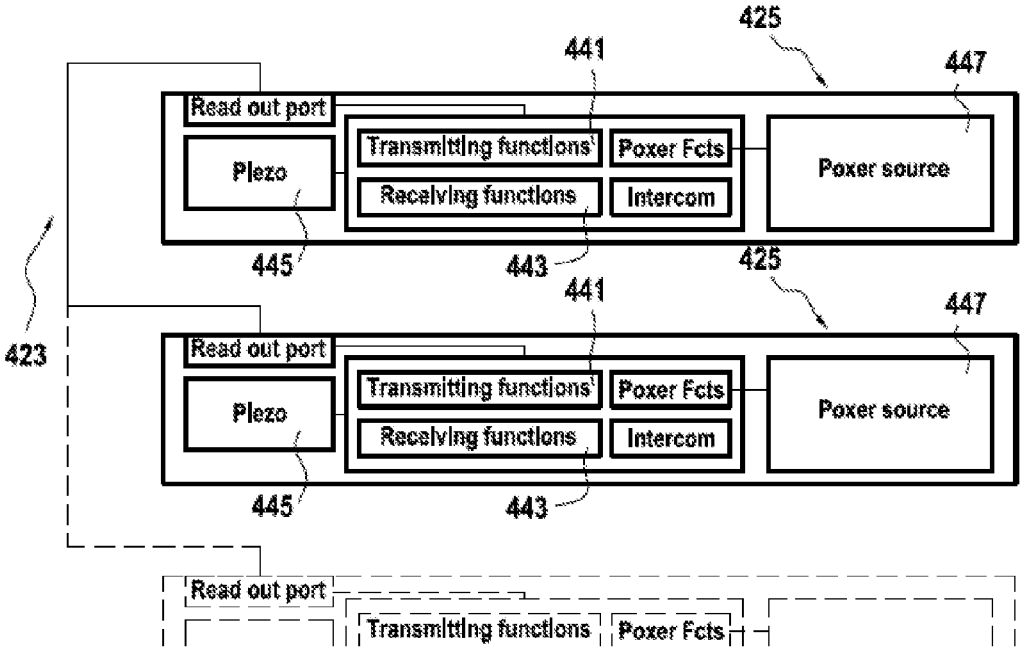
FIG. 4 depicts a schematic view of a node of a communication system in accordance with embodiments disclosed herein.

Referring now to FIG. 4, a schematic of multiple repeaters 425 used within a communication system in accordance with one or more embodiments is shown. In this embodiment, the communication system is shown to have "horizontal redundancy" wherein each node includes at least two repeaters 425 able to communicate with one another, or alternatively the communication system may include three repeaters 425 at a node (represented by the dotted line).

When using one or more of the repeaters 425 within a node, the repeaters 425 may act as "twins," being in communication with each other, such as through the use of a wire and/or wirelessly, and including the same or similar electronic component and functionalities. For example, if the repeaters 425 are in wireless communication with each other, the repeaters 425 may be configured to each transmit and receive signals to each other, such as through the use of acoustic and/or electromagnetic signals. Otherwise, if not wirelessly communicating between the repeaters 425, the repeaters 425 may have a wire attached thereto between the repeaters 425 to enable communication therebetween.

Further, the repeaters 425 may each include a transmitter 441 and a receiver 443. For example, as shown in FIG. 4, the repeaters 425 may include a transceiver that is capable of performing the functions of a transmitter 441 and a receiver 443, such as a piezoelectric transceiver 445. As used herein, a repeater may include the use of and functions of a transmitter and a receiver, as shown. However, those having ordinary skill in the art will appreciate that in other embodiments, rather than including both functions of a transmitter and a receiver, each node within a communication system may also include the functions of only one transmitter and receiver. For example, in one embodiment, a node may include the use of one transmitter and two receivers, or vice versa, such as to save space, power and/or costs related to the extra components within each node, as desired. As such, though the embodiment shown in FIG. 4 includes the use of one transmitter and one receiver per repeater at each node, other embodiments in accordance with those disclosed herein may also be developed that do not include the use and/or functions of both a transmitter and a receiver.

Referring still to FIG. 4, the repeaters 425 may also include a battery 447, such as a lithium battery, disposed therein or electrically connected thereto. The battery 447 may provide a power source to one or more of the repeaters 425, such as by using a battery 447 with each of the repeaters 425, as shown. Alternatively, each battery 447 may also be configured to provide power to each of the other repeaters 425 that the battery 447 is communicatively connected, such as through a wire, or only one battery 447 may be provided for the entire node 423. As such, though in the embodiment in FIG. 4 includes the use of one battery per repeater at each node, other embodiments in accordance with those disclosed herein may also be developed that do not include the use and/or functions of a battery within each repeater or at each node.

By having the repeaters 425 at each node 423 in communication with each other, the repeaters 425 may be able to transmit to and receive signals from each other related to each of the repeaters 425 functionality and power. For example, when one of the repeaters 425 loses functionality of one of its components, the other of the repeaters 425 may then provide functionality of that particular lost component, or the other of the repeaters 425 may replace the complete functionality for the failing repeater 425. Further, when one of the repeaters 425 loses power, the other of the repeaters 425 may provide power to, or effectively replace, any one of the repeaters 425 within the node 423, as necessary.

Furthermore, by having the use of more than one repeater 425 at each node 423, the repeaters 425 may be configured such that when one repeater 425 is powered on, the other repeater 425 is powered off. Moreover, by having the use of more than one repeater 425 at each node 423, the repeaters 425 may be configured to power off certain electronic components or functionalities of one repeater 425 while certain electronic components or functionalities of the other repeater 425 is powered on. As such, the repeaters 425 may then alternate between each other during use to conserve power within the batteries 447 of the repeaters 425. Such conservation of battery power may be referred to as "sleep" or "hibernation" mode. Depending on the microcontroller and programmed logic, examples of the portion of the repeater 425 (i.e., electronic components and/or functionalities) that may be powered off or on may include, certain peripheral components, the RAM, and possibly the MCU clock. Upon "waking up" from sleep mode or hibernation mode, one repeater 425 may transfer its knowledge or information gained to the other repeater 425 at the node 423 during the time duration that the other repeater 425 was asleep/inactive.

Figure 5A:
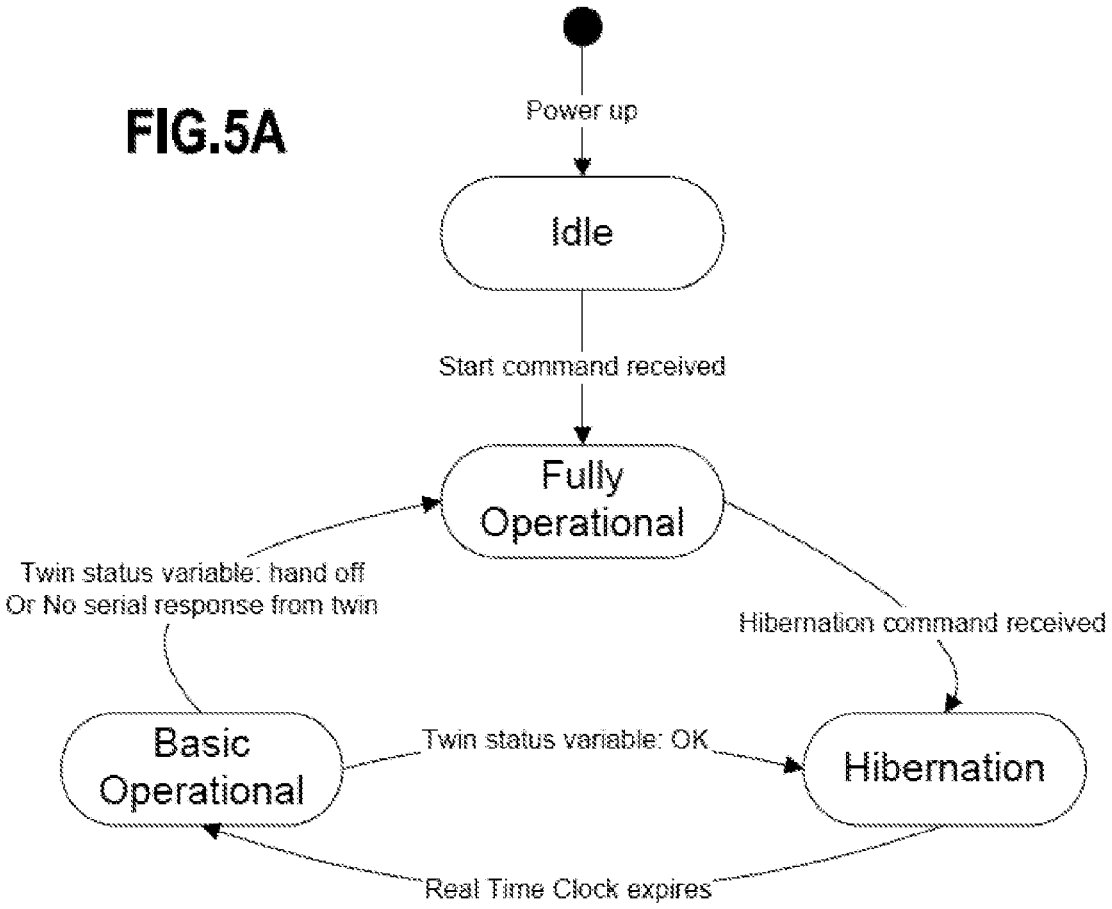
FIGS. 5A-5B depict diagrams illustrating a hibernation management of a system having more than one repeater at each node in accordance with embodiments disclosed herein.
Figure 5B:
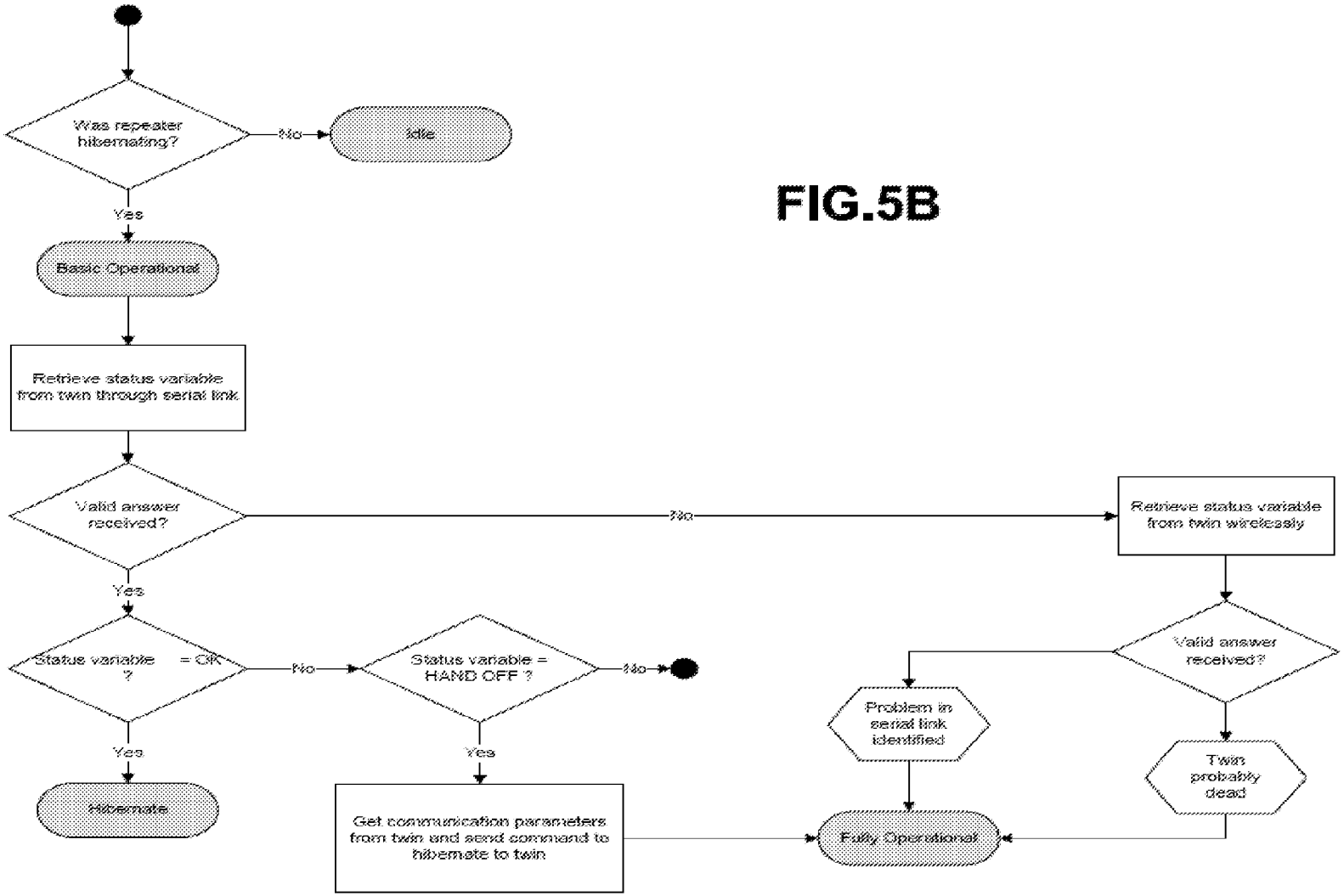

Referring now to FIGS. 5A-5B, diagrams illustrating hibernation management of a system having more than one repeater at each node are shown in accordance with one or more embodiments of the present disclosure. In a preferred embodiment, effective hibernation management allows the set of repeaters 425 at each node 423 to conserve power as well as being operationally available to send and receive communication signals. In FIG. 5A, an example of various states of a repeater 425 is depicted. As shown, a repeater 425 may be powered up to an Idle state, waiting on a command. Once a command is received, the repeater 425 may become Fully Operational, capable of sending and receiving wireless communication signals between the surface and a location downhole, or between downhole locations themselves. The repeater 425 may receive a command to enter a Hibernation state, where certain electric components and/or functionalities of the repeater 425 are powered down. At the expiration of a predetermined time for Hibernation, or alternatively upon receiving a specific command, the repeater 425 may wake up from Hibernation to enter a Basic Operational state, capable of checking the status of at least one other repeater 425 either at the same node 423 or at a node within a range of communication. For example, if the other repeater 425 is operational and fully active, the repeater 425 may re-enter the Hibernation state. However, if the other repeater 425 is not sufficiently responding to status checks, if the other repeater has indicated that a hand-off is desired, or if the real time clock of the repeater 425 has expired, the repeater 425 may enter a Fully Operational state. It will be understood that in achieving effective hibernation management, various states may be added in accordance with one or more embodiments disclosed herein.

Referring to FIG. 5B, a logic diagram illustrating a hand-off between one or more repeaters at the same node is depicted in accordance with one or more embodiments of the present disclosure. An effective hand-off between at least two repeaters preferably allows one repeater to learn as much information as possible from the other repeater during the time of hibernation. Additionally, an effective hand-off between at least two repeaters consists of a negligible "blind time," meaning the time of inoperability, wherein none of the repeaters at the same node are available for wireless communication. At the Basic Operational state, the repeater 425 may retrieve the status of a neighboring repeater at the same node through a serial link. If the status variable of the other repeater is OK, and it is not ready for a hand-off, then the repeater may re-enter the Hibernation state. If the status variable is not OK, and the status variable is ready for a hand-off, then the repeater may gather all information from the other repeater received during the inactive period, gather all communication parameters (e.g., communication frequency, bit rate, preferred communication partners, and the like), and send a command to at least one other repeater to enter a Hibernation state. At such time, the repeater may become Fully Operational, capable of sending and receiving wireless communication signals. From the Basic Operational state, if the status check does not produce a valid response from the other repeater, the repeater may attempt to perform a status check wirelessly, for example, acoustically or electromagnetically. If the wireless status check produces a valid response, then there is a high likelihood that the serial link is damaged or not working properly, and the repeater may enter a Fully Operational state, or alternatively (not shown) may record the error and re-enter a Hibernation state. If, however, the wireless status check does not produce a valid response after a wired and wireless attempt, the other "twin" repeater is likely non-operational, and the repeater enters a Fully Operational state. Various decisions and checks may be added in accordance with one or more embodiments disclosed herein. For example, a repeater may perform a status check of its twin repeater by wirelessly communicating with a repeater at another node. Further, a repeater may periodically gather information, such as communication parameters and communicated data, from its twin without entering into a Fully Operational state.

Figure 5C:
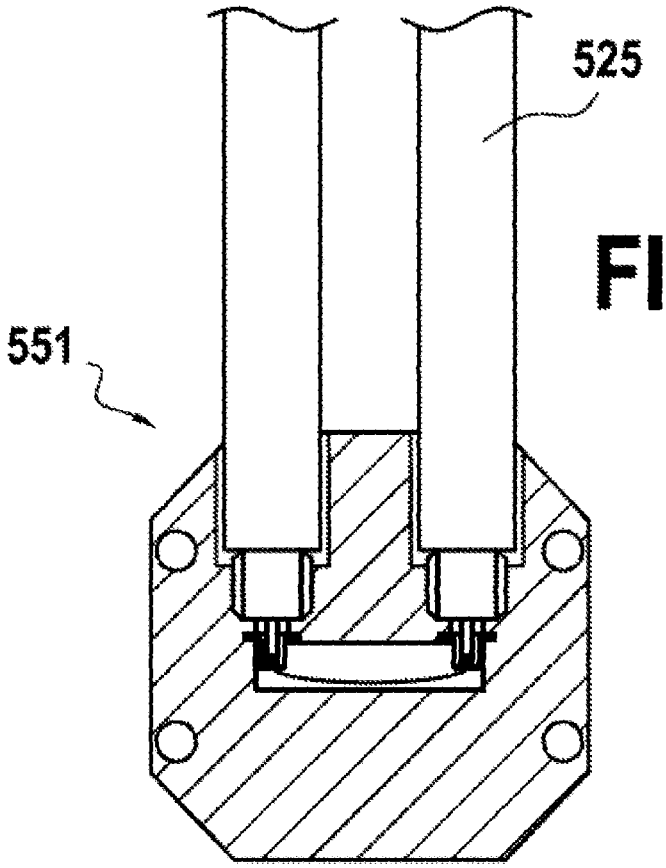
FIG. 5C depicts a schematic view of a portion of a set of repeaters secured to a node in accordance with embodiments disclosed herein.

Referring now to FIG. 5C, an example of a securing mechanism 551 used to secure repeaters 525 to a tubular member in accordance with one or more embodiments is shown. Specifically, the securing mechanism 551 may be used to secure multiple repeaters 525 to a tubular member, in which the tubular member may then be disposed downhole within a borehole for use within a communication system. The securing mechanism 551 and the repeaters 525 may be disposed within a recess of the tubular member, in which the recess may enable the securing mechanism 551 and the repeaters 525 to have a diameter no larger than that of the tubular member 561. Further, the securing mechanism 551 and the repeaters 525 may be disposed upon an outside diameter of the outer surface of the tubular member, in which this arrangement may enable the securing mechanism 551 to attach to the tubular member 561 without having to form a recess within the tubular member.

As such, with the securing mechanism 551, at least a portion of the repeaters 525 may be disposed within the securing mechanism 551. For example, as shown in FIG. 5C, the ends of the repeaters 525 are disposed and received within the securing mechanisms 551. By having at least a portion of the repeaters 525 disposed within the securing mechanisms 551, the repeaters 525 may be electrically connected to each other. For example, the repeaters 525 may be electrically connected using a wire, if desired, the repeaters 525 may be configured as a bus within the securing mechanism 551, such as shown particularly in the schematic view in FIG. 5C.

Figure 6:
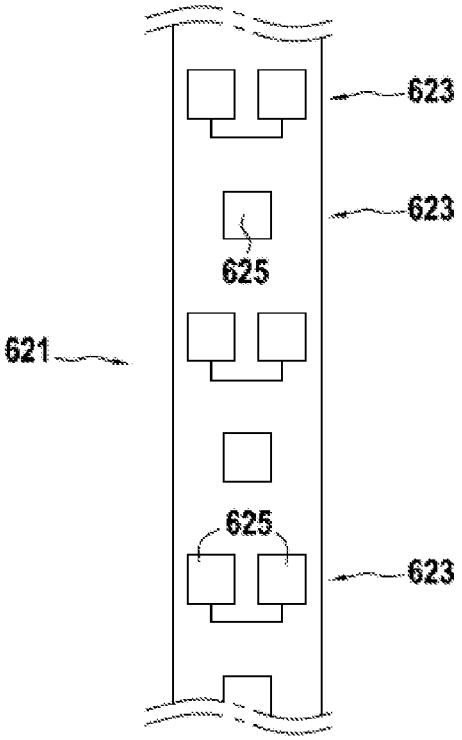
FIG. 6 depicts a schematic view of a node of a communication system in accordance with embodiments disclosed herein.

Those having ordinary skill in the art will appreciate that in accordance with one or more embodiments disclosed herein, one or more of the nodes of the communication system may include different numbers of repeaters, as desired. For example, with reference to FIG. 6, a schematic view of a long hop section 621 in accordance with one or more embodiments is shown. In this embodiment, rather than having multiple repeaters within every node of the long hop section 621, the nodes 623 may alternate by having one repeater 625 disposed within some nodes 623, and more than one repeater 625 disposed within every other node 623. As such, one or more embodiments disclosed herein may have only one repeater disposed within one or more nodes of the communication, with multiple repeaters then disposed in the other nodes of the system. Such systems may then still offer improved reliability over a system having only one repeater within each node.

Embodiments disclosed herein may provide for one or more of the following advantages. First, embodiments disclosed herein may provide a communication system that allows for data communication within a borehole. For example, by disposing a long hop section in accordance with embodiments disclosed herein into a borehole, a communication system may provide data communication within the long hop section of the communication system, in addition to providing communication between the short hop section and the surface of a communication system. Further, embodiments disclosed herein may provide a communication system that increases communication reliability and efficiency of production for a borehole. For example, a communication system in accordance with embodiments disclosed herein may provide for increased reliability of usage by having multiple repeaters disposed at one or more nodes within a long hop section, which thereby may prevent the need for additional redeployment of communication components downhole.

Furthermore, it should be understood by those having ordinary skill that the present disclosure shall not be limited to specific examples depicted in the Figures and described in the specification. As such, various mechanisms may be used to expand the arms to the borehole wall without departing from the scope of the present disclosure. While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. A system for transmitting data within a borehole, comprising:

a first communication node disposed at a first location within the borehole, the first communication node including a first transmitter configured to transmit a first signal; and a second communication node disposed at a second location within the borehole remote from the first location, the second communication node including a first receiver, a second receiver, a second transmitter, and a communication link to communicatively couple the second transmitter, the first receiver, and the second receiver at the second location, wherein each of the first receiver and the second receiver are configured to receive the first signal transmitted from the first transmitter, and wherein the second transmitter communicates information associated with the first receiver to the second receiver at the second location via the communication link.

2. The system of claim 1, wherein the second transmitter disposed at the second location within the borehole is configured to generate a second signal.

3. The system of claim 2, wherein each of the first receiver and the second receiver are configured to receive the second signal generated by the second transmitter.

4. The system of claim 2, wherein the first communication node further comprises a third receiver disposed at the first location and configured to receive the second signal generated by the second transmitter.

5. The system of claim 2, wherein the second transmitter and the first receiver comprise a repeater, wherein the second signal generated by the second transmitter corresponds to the first signal received by the first receiver.

6. The system of claim 5, wherein the repeater comprises a piezoelectric transceiver that is configured to receive the first signal and re-transmit the first signal as the second signal.

7. The system of claim 4, wherein one of the first transmitter and the second transmitter is configured to generate one of an acoustic signal and an electromagnetic signal.

8. The system of claim 7, wherein one of the first receiver and the third receiver is configured to receive one of the acoustic signal and the electromagnetic signal.

9. The system of claim 1, wherein the communication link is a wired link that communicatively connects the second transmitter, the first receiver, and the second receiver at the second location.

10. The system of claim 1, wherein the communication link is a wireless link, and the second transmitter, the first receiver, and the second receiver are configured to communicate with each other wirelessly.

11. The system of claim 1, wherein the first receiver comprises a first repeater and the second receiver comprises a second repeater.

12. The system of claim 11, wherein the first repeater and the second repeater are configured such that when at least a portion of one of the first repeater and the second repeater is powered on, at least a portion of the other of the first repeater and the second repeater is powered off.

13. The system of claim 1, wherein the second communication node further comprises a third receiver disposed at the second location and configured to receive the first signal transmitted by the first transmitter.

14. The system of claim 13, wherein the third receiver comprises a third repeater.

15. The system of claim 1, further comprising a securing mechanism to secure the first receiver and the second receiver to a tubular member disposed within the borehole, where the securing mechanism secures the first receiver and the second receiver at the second location.

16. The system of claim 15, wherein the securing mechanism secures to an outer surface of the tubular member and at least a portion of the first receiver and the second receiver are disposed within the securing mechanism.

17. A system for transmitting data within a borehole, comprising:

a first communication node disposed at a first location within the borehole, the first communication node including a first transmitter configured to transmit a first signal; and a second communication node disposed at a second location within the borehole remote from the first location, the second communication node including a first repeater, a second repeater, and a communications link communicatively coupling the first repeater and the second repeater at the second location, wherein each of the first repeater and the second repeater are configured to receive the first signal and re-transmit the first signal as a second signal, and wherein the first repeater and the second repeater are configured to transmit and receive communications to and from each other at the second location via the communications link.

18. The system of claim 17, further comprising a third repeater disposed at a third location within the borehole remote from the second location and a fourth repeater disposed at a fourth location within the borehole remote from the third location, wherein each of the third repeater and the fourth repeater are configured to receive the first signal re-transmitted as the second signal from one of the first repeater and the second repeater.

19. A method for transmitting data within a borehole, the method comprising:

disposing a first communication node at a first location within the borehole, the first communication node including a first transmitter;

disposing a second communication node at a second location within the borehole remote from the first location, the second communication node including a first receiver, a second receiver, a second transmitter, and a communication link to communicatively couple the first receiver, the second receiver, and the second transmitter at the second location, wherein the second transmitter is configured to communicate information associated with each of the first receiver and the second receiver to the other of the first receiver and the second receiver at the second location via the communication link; and transmitting a signal with the first transmitter to one of the first receiver and the second receiver.

20. The method of claim 19, wherein the first receiver comprises a first repeater and the second receiver comprises a second repeater.

21. The method of claim 20, further comprising:

communicating between the first repeater and the second repeater via the communication link at the second location such that when at least a portion of one of the first repeater and the second repeater is powered on, at least a portion of the other of the first repeater and the second repeater is powered off.

22. The method of claim 19, further comprising:

securing the first receiver and the second receiver with a securing mechanism to a tubular member; and disposing the tubular member within the borehole.

* * * * *